United States Patent [19]

Mosimann et al.

[11] Patent Number: 4,935,033

[45] Date of Patent: Jun. 19, 1990

[54] PROCESS FOR THE AQUEOUS DYEING OF NATURAL POLYAMIDE FIBRES USING REACTIVE DYES AND ASSISTANT MIXTURE OF QUATERNARY AMMONIUM POLYGLYCOL, ACID ESTER OF POLYGLYCOL AND FATTY ALCOHOL POLYGLYCOL ETHER

[75] Inventors: Walter Mosimann, Therwil; Dieter Mäusezahl, Biel-Benken, both of Switzerland

[73] Assignee: Ciba-Geigy Corporation, Ardsley, N.Y.

[21] Appl. No.: 247,204

[22] Filed: Sep. 21, 1988

[30] Foreign Application Priority Data

Oct. 14, 1987 [CH] Switzerland ..... 4024/87

[51] Int. Cl.[5] ..... D06P 1/61; D06P 3/10; C09B 62/09

[52] U.S. Cl. ..... 8/543; 8/549; 8/582; 8/588; 8/597; 8/599; 8/604; 8/606; 8/609; 8/681; 8/687; 8/696; 8/917

[58] Field of Search ..... 8/543, 549, 604, 606, 8/588, 582

[56] References Cited

U.S. PATENT DOCUMENTS 3,529,922 9/1970 Berger et al. ..... 8/604
4,713,482 12/1987 Topfl et al. ..... 8/557
4,778,919 10/1988 Topfl ..... 8/582

FOREIGN PATENT DOCUMENTS 483637 5/1975 Austria .
2802304 7/1978 Fed. Rep. of Germany .

*Primary Examiner*—A. Lionel Clingman
*Attorney, Agent, or Firm*—Edward McC. Roberts

[57] ABSTRACT

Natural polyamide fibres, in particular wool, are dyed by means of reactive dyes using the exhaust method in the presence of a dyeing assistant consisting of a combination of (a) quaternized ammonium compounds of polyglycol compounds and (b) of acidic esters or salts thereof derived from at least dibasic oxyacids and from polyglycol compounds, both the quaternary ammonium compounds and the acidic esters being derived from an aliphatic amine having 12 to 24 carbon atoms in the aliphatic moiety. The process comprises carrying out the dyeing in the additional presence of (c) a fatty alcohol/polyalkylene glycol ether of the formula $$\text{R-O-(alkylene-O)}_m\text{-H} \quad (1)$$

in which R is an aliphatic radical having at least 8 carbon atoms, "alkylene" is an ethylene radical or propylene radical and m is 3 to 25.

13 Claims, No Drawings

PROCESS FOR THE AQUEOUS DYEING OF NATURAL POLYAMIDE FIBRES USING REACTIVE DYES AND ASSISTANT MIXTURE OF QUATERNARY AMMONIUM POLYGLYCOL, ACID ESTER OF POLYGLYCOL AND FATTY ALCOHOL POLYGLYCOL ETHER

The present invention relates to a process for the dyeing of natural polyamide fibres, in particular wool, by means of reactive dyes using the exhaust method and in the presence of a dyeing assistant consisting of a combination of (a) quaternized ammonium compounds of polyglycol compounds and (b) acidic esters or salts thereof derived from at least dibasic oxyacids and from polyglycol compounds, not only the quaternary ammonium compounds but also the acidic esters being derived from an aliphatic amine having 12 to 24 carbon atoms in the aliphatic moiety, which comprises carrying out the dyeing additionally in the presence (c) of a fatty alcohol/polyalkylene glycol ether of the formula $$R—O—(\text{alkylene}—O)_m—H \qquad (1)$$

in which R is an aliphatic radical having at least 8 carbon atoms, "alkylene" is an ethylene radical or a propylene radical and m is 3 to 25.

Both components (a) and (b) and polyglycol ether (c) can be present as individual compounds or as mixtures with one another. The ratio of the amounts of the combination of components (a) and (b) to component (c) is advantageously between 2:1 and 1:1, preferably 1.6:1 and 1.2:1.

Substituent R is advantageously a hydrocarbon radical of an unsaturated or saturated aliphatic monoalcohol having 8 to 24 carbon atoms. The hydrocarbon radical can be straight-chain or branched. Preferably, R is an alkyl or alkenyl radical having 12 to 22 carbon atoms.

Suitable aliphatic saturated monoalcohols are natural alcohols, for example lauryl alcohol, myristyl alcohol, cetyl alcohol, stearyl alcohol, arachidyl alcohol or behenyl alcohol, and also synthetic alcohols, for example oxo alcohols such as, in particular 5-methylheptan-3-ol, 2-ethylhexanol, 2-octanol, trimethylnonyl alcohol, decanol, hexadecyl alcohol or linear primary alcohols (Alfols) having 8 to 18 carbon atoms.

Examples of unsaturated aliphatic monoalcohols are dodecenyl alcohol, hexadecenyl alcohol or, in particular, oleyl alcohol.

The alcohols can be present individually or in the form of mixtures of two or more components, for example mixtures of alcohols having alkyl and/or alkenyl groups derived from fatty acids of soya oil, palm-kernel oil or from tallow oils.

m is preferably 10 to 20 or, in particular, 12 to 18.

$(\text{Alkylene}—O)_m$ chains are preferably of the ethylene glycol, propylene ethylene glycol or ethylene propylene glycol type; particular preference is given to the first type.

The amounts of fatty alcohol/polyglycol ethers (c) present in the dyeing liquors are, depending on the dye, advantageously between 0.3 and 2.5% by weight, preferably 0.5 to 2% by weight, relative to the material to be dyed.

The quaternary ammonium salts used as component (a) of the assistant mixture can be reaction products of alkylene oxide adducts from aliphatic or araliphatic mono- and/or diamines containing tertiary amino groups and an aliphatic radical having 12 to 24 carbon atoms with a quaternizing agent. This type of compound is described, for example, in Swiss Patent 465,553.

Preferably, component (a) consists of a quaternary ammonium compound of the formula

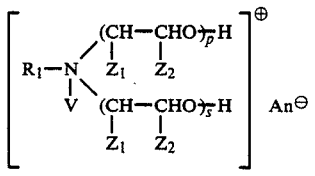

(2)

in which $R_1$ is an aliphatic hydrocarbon radical, preferably an alkyl or alkenyl radical having 12 to 22 carbon atoms, V is a substituted or unsubstituted alkyl radical, one of $Z_1$ and $Z_2$ is hydrogen, methyl or phenyl and the other hydrogen, $An^{\ominus}$ is an anion of an inorganic or organic acid and p and s are each 1 to 100, the sum of p and s being 2 to 100.

Suitable components (b) are advantageously acidic esters or salts thereof of compounds of the formula

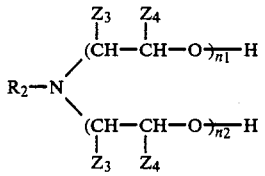

(3)

or a quaternized product of the acidic ester or salts thereof in which $R_2$ is an aliphatic hydrocarbon radical having 12 to 22 carbon atoms, in particular 12 to 18 carbon atoms, one of $Z_3$ and $Z_4$ is hydrogen, methyl or phenyl and the other is hydrogen and $n_1$ and $n_2$ are whole numbers, the sum $n_1+n_2$ being 2 to 100.

The acidic esters can be present in the form of mono- or diesters and as free acids or preferably as salts, for example alkali metal salts or ammonium salts. Alkali metal salts are in particular sodium salts and potassium salts and ammonium salts are ammonium, trimethylammonium, monoethanolammonium, diethanolammonium and triethanolammonium salts. Preferably, the acidic esters are used as ammonium salts.

The acidic esters used as components (b) and the corresponding starting materials are known from Swiss Patent 465,553, EP-A 197,005, EP-A 235,088 or from German Offenlegungsschrift 2,834,686 and can be prepared by the processes described in these publications.

The amine polyglycol compounds required for the preparation of the quaternary ammonium compounds of the formula (1) and of the acidic esters are prepared by the addition of ethylene oxide, propylene oxide, styrene oxide or a combination thereof onto aliphatic amines having an aliphatic hydrocarbon radical of 12 to 24 carbon atoms.

Quaternization of the adducts obtained gives the quaternary ammonium compounds of the formula (1) (component (a)). Not only the addition of alkylene oxide but also the quaternization can be carried out by methods known per se. Advantageously, the preparation of component (b) is carried out by esterification of the adducts or the quaternary ammonium salts thereof with at least dibasic oxyacids under such conditions that one or two ester groups, preferably in the form of the salts mentioned, are formed.

The polybasic oxyacids for the formation of the acidic esters can be optionally sulphonated, organic, preferably aliphatic, dicarboxylic acids of 3 to 6 carbon atoms, for example maleic acid, malonic acid, succinic acid or sulphosuccinic acid, or, in particular, polybasic inorganic oxyacids, for example sulphuric acid or orthophosphoric acid. Instead of the acids, functional derivatives thereof, such as anhydrides, acid halides, esters or amides can be used. Examples of these functional derivatives are maleic anhydride, chlorosulphonic and, in particular, sulphamic acid.

The esterification is usually carried out by simply mixing the reactants with heating, advantageously to a temperature between 50° and 100° C. The free acids formed first can then be converted to the corresponding alkali metal salts or ammonium salts. The conversion to the salts is carried out in a conventional manner by the addition of bases, for example ammonia, monoethanolamine, triethanolamine or alkali metal hydroxides, for example sodium hydroxide or potassium hydroxide. According to a particularly preferred embodiment, acidic sulphuric esters are prepared directly in the form of their ammonium salts by heating the alkylene oxide adducts, advantageously in the presence of urea, with sulphamic acid.

Suitable esters contain either an acidic maleic ester group or, in particular, one or two acidic sulphuric ester groups preferably present in the form of their alkali metal salts or ammonium salts.

In formula (2) and (3), $R_1$ and $R_2$ are preferably an alkyl or alkenyl radical having 12 to 22 carbon atoms. $Z_1$, $Z_2$, $Z_3$ and $Z_4$ are preferably hydrogen. The sums of p+s and $n_1+n_2$ are each preferably 5 to 40. In formula (2), V is preferably methyl, ethyl, benzyl, $—CH_2CONH_2$ or $$—CH_2—\underset{\underset{OH}{|}}{CH}—CH_2Cl.$$

Alkyl $R_1$ and $R_2$ are, for example, lauryl, myristyl, cetyl, palmityl, stearyl, arachidyl or behenyl radicals. Suitable alkenyl radicals for $R_1$ and $R_2$ are, for example, dodecenyl, hexadecenyl, oleyl or octadecenyl. The radicals $R_1$ and $R_2$ can be derived from chemically uniform amines or from mixtures of amines. Individual suitable amines are dodecylamine (laurylamine), myristylamine, cetylamine, palmitylamine, stearylamine, arachidylamine, behenylamine, lignocerylamine, oleylamine, and erucylamine.

The amine mixtures which are preferably used are those which are formed upon conversion of natural fats or oils, for example palm-kernel oil, tallow oil, soya or coconut oil, to the corresponding amines. Preference is given to tallow fatty amine. This amine is a mixture of 30% of hexadecylamine, 25% of octadecylamine and 45% of octadecenylamine.

Components (a) and (b) are usually used in a weight ratio of 3:1 to 1:3, preferably 1.5:1 to 1:1.5.

The amounts of assistant mixture consisting of components (a) and (b), which are added to the dye baths, are between 0.05 to 5% by weight, preferably 0.5 to 2.5% by weight, based on the fibre material to be dyed.

Preferably, the assistant mixtures usable according to the invention contain the following components as components (a) and (b):

(Aa) a quaternary ammonium salt of the formula

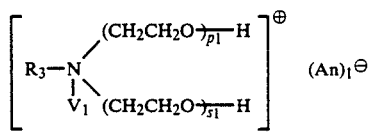

(5)

and (Bb) an acidic ester or a salt thereof of a compound of the formula

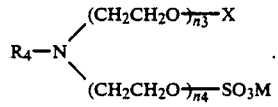

(6)

In formulae (5) and (6), X is hydrogen or $SO_3M$, M is hydrogen, an alkali metal or $—NH_4$, $R_3$ and $R_4$ independently of one another, are each alkyl or alkenyl having 12 to 22 carbon atoms, $V_1$ is methyl, ethyl, benzyl, $—CH_2CO—NH_2$ or $$—CH_2—\underset{\underset{OH}{|}}{CH}—CH_2—Cl,$$

$(An)_1^{\ominus}$ is the chloride or methyl sulphate ion, $s_1$, $p_1$, $n_3$ and $n_4$ are whole numbers, the sum of $(p_1+s_1)$ and $(n_3+n_4)$ being between 5 and 15 in each case. The mixing ratio is preferably 1:1.5 to 1.5:1. In formula (5), $V_1$ is preferably methyl or $—CH_2—CONH_2$ and, in formula (6), X is preferably hydrogen.

The assistants used in the process according to the invention are suitable in particular for improving the levelness of the fibre and additionally allow complete exhaustion of the dyeing baths. The addition of the non-ionogenic component (c) serves in particular for preventing adducts or precipitations formed from dye and assistant mixture, which are then dissolved in any remaining wool fat and attach themselves to the dyeing apparatus.

The fibre material consisting of natural polyamides, which can be dyed according to the invention, is in particular wool, and also mixtures of wool/polyamide, wool/polyester or wool/polyacrylonitrile and also silk. This fibre material can be present in a wide range of make-up forms. Suitable examples are: loose fibre, tops, yarn, fabric, knitwear or carpets. The wool can be normal wool or wool with non-felting finish.

Reactive dyes for the dyeing of natural polyamide fibre material, in particular of normal wool or of wool with non-felting finish or of the wool component of fibre mixtures by the process according to the invention can be organic dyes known by this term—independent of the type of their reactive group.

This class of dyes is designated in Colour Index 3rd edition 1971, as "Reactive Dyes". They are predominantly those dyes containing at least one group which is capable of reacting with polyhydroxyl fibres (cellulose fibres) or polyamide fibres, in particular wool, or contain a precursor of such a group or contain a substituent which is capable of reacting with polyhydroxy fibres or polyamide fibres.

Suitable basic structures of reactive dyes are in particular those from the series of mono-, dis- or polyazo dyes, including formazan dyes and also anthraquinone, xanthene, nitro, triphenylmethane, naphthoquinoneamine and phthalocyanine dyes, it being possible for the azo and phthalocyanine dyes to be either free of metals or to contain metals.

Examples of reactive groups and precursors forming these reactive groups are epoxy groups, the ethyleneimido group, the vinyl grouping in the vinylsulphone or acryloyl radical and also the β-sulphatoethylsulphone group, the β-chloroethylsulphone group or the β-dialkylaminoethylsulphone group.

Reactive substituents in reactive dyes are those which are easily detachable and leave an electrophilic radical behind.

Suitable examples of such substituents are 1 or 2 halogen atoms in an aliphatic acyl radical, for example in the β-position or the α- and β-position of a propionyl radical or in the α- and/or β-position of an acryloyl radical, or 1 to 3 halogen atoms on the following ring system: pyridazine, pyrimidine, pyridazone, triazine, quinoxaline or phthalazine.

Dyes containing two or more identical or different reactive groups can also be used.

Preferably, reactive dyes contain as reactive substituents chloroacetyl, α-bromoacryloyl, α,β-dibromopropionyl, 2,4-difluoro-5-chloropyrimidin-6-yl, 2,4-dichloro-1,3,5-triazinyl or 2,4,5-trichloropyrimidin-6-yl.

The reactive dyes can contain acid, salt-forming substituents, for example carboxyl groups, sulphuric and phosphoric ester groups, phosphono groups or preferably sulpho groups. Preference is given to reactive dyes having at least two sulpho groups, in particular reactive dyes having a metal-free azo basic structure, which preferably has 2 to 4 sulpho groups.

It is also possible to use mixtures of reactive dyes or mixtures of a reactive dye and customary anionic wool dyes, with which bichrome or trichrome dyeings can be produced.

A preferred embodiment of the process according to the invention consists in using reactive dyes of the formula

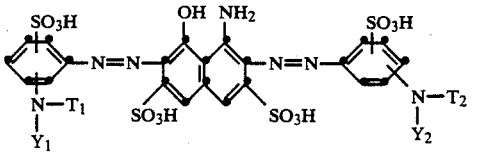

(7)

in which $T_1$ and $T_2$, independently of one another, are each hydrogen or $C_1$–$C_4$-alkyl and $Y_1$ and $Y_2$, independently of one another, are each chloroacetyl, α-bromoacryloyl, α,β-dibromopropionyl, 2,4-dichloro-s-triazinyl, 2,4-difluoro-5-chloropyrimidin-6-yl or 2,4,5-trichloropyrimidin-6-yl.

Particular preference is given to those dyes in which $—NT_1Y_1$ and $—NT_2Y_2$ are identical and $T_1$ and $T_2$ are hydrogen. $Y_1$ and $Y_2$ are preferably α-bromoacryloyl or α,β-dibromopropionyl.

The dyeing is carried out by the exhaust method. The amount of dyes added to the dyeing liquor depends on the desired colour strength; in general, amounts of 0.01 to 10 percent by weight, preferably 0.1 to 5 percent by weight, based on the fibre material used, have proven to be useful.

The liquor ratio can be chosen within a wide range, for example 3:1 to 100:1, preferably 6:1 to 30:1.

The dyeing baths can contain mineral acids, for example sulphuric acid or phosphoric acid, organic acids, advantageously aliphatic carboxylic acids such as formic acid, acetic acid, oxalic acid or citric acid and/or salts such as ammonium acetate, ammonium sulphate or sodium acetate. The acids serve in particular for adjusting the pH of the liquors used according to the invention, which as a rule is 4 to 7, preferably 4.3 to 6.

The dyeing liquors can also contain further additives, for example wool-protecting, dispersing and wetting agents and also antifoams.

Special apparatuses are not necessary in the process according to the invention. The customary dyeing apparatuses can be used, for example open bath, tops, hank yarn or pack-dyeing apparatuses, jig-dyeing, paddle-dyeing, beam-dyeing, circulation-dyeing or jet-dyeing apparatuses or winches.

Advantageously, the dyeing is carried out at a temperature in the range from 60° to 120° C., preferably 70° C. to the boiling temperature (100°–102° C.). The dyeing time is within conventional limits and is as a rule 20 to 120 minutes.

After the dye has been exhausted, fixing alkalis, for example aqueous ammonia, alkali metal hydroxides, alkali metal carbonates or alkali metal bicarbonates are usually added to the dyeing liquors. The pH of the alkali-containing dyeing baths is advantageously 7.5 to 9, preferably 8 to 8.5.

Advantageously, the dyeing of the fibre material is carried out by treating the material to be dyed for a short time with an aqueous liquor containing the acid, the assistant mixture of components (a) and (b) and the non-ionogenic additive (c) and having a temperature of 40° to 60° C. and then adding the reactive dye to the same bath. The temperature is then slowly increased, and the material is dyed in a range from 80° to 100° C. for 20 to 90 minutes, preferably 30 to 60 minutes. After the fixing alkalis, preferably aqueous ammonia, have been added, the material to be dyed is treated for a further 10 to 20 minutes by alkali at 70° to 90° C. Finally the dyed material is removed and rinsed, acidified and dried as usual.

Using the dyeing process according to the invention gives level and strong dyeings which are also distinguished by good crock fastness properties and high colour yields. In addition, the other fastness properties of the dyeings, for example light fastness properties and wet fastness properties are not adversely affected by adding the non-ionogenic component (c). In particular, the process according to the invention achieves complete exhaustion of the dyeing bath without precipitations and deposits of dye in the dyeing bath.

In the examples which follow, parts and percentages are by weight.

EXAMPLE 1

10 g of worsted wool yarn are pretreated at 50° C. over a period of 15 minutes in a dyeing bath containing 200 ml of water 0.3 g of acetic acid (80%)

0.1 g of an adduct of 18 mol of ethylene oxide onto 1 mole of a $C_{12}$–$C_{18}$ fatty alcohol mixture and 0.2 g of assistant mixture $A_1$ consisting of (1) the adduct of 7 mol of ethylene oxide onto 1 mole of tallow fatty amine quaternized with chloroacetamide and (2) the ammonium salt of the acidic sulphuric monoester of the adduct of 7 mol of ethylene oxide onto 1 mole of tallow fatty amine (mixing ratio 1:1), the material carrier with the wool yarn being constantly agitated, while the liquor is stationary.

0.24 g of a dye of the formula

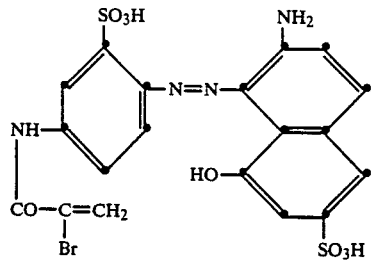

(21)

is then added. The pH of the dyeing bath is 4.5–5. The bath temperature is increased to 60°–70° C. at a rate of 0.5°–1° C. per minute and maintained at 60°–70° C. for 15 minutes. The temperature is then increased to the boiling temperature at a rate of 0.5°–1° C. per minute and maintained at 98°–100° C. for 60–90 minutes. The dyeing bath is then cooled to 80° C. and adjusted to a pH of 8.5 with aqueous ammonia (25%). 0.2 g of a sulphonated naphthalene/formaldehyde condensation product is then added, after which the material to be dyed is maintained at 85° C. and a pH of 8.5 for 10–15 minutes. The material to be dyed is then rinsed as usual with 200 ml of water containing 0.2 g of 85% formic acid, acidified and dried. A red-coloured worsted yarn having good wearing properties is obtained. During the entire dyeing process, no precipitations have occurred. The dyeing glass and the material carrier show no staining whatsoever.

EXAMPLE 2

10 g of worsted wool yarn are pretreated at 50° C. over a period of 15 minutes in a dyeing bath containing 300 ml of water 0.3 g of acetic acid (80%)

0.15 g of an adduct of 18 mole of ethylene oxide onto 1 mol of a $C_{12}$–$C_{18}$ fatty alcohol mixture and 0.2 g of assistant mixture $A_1$ consisting of (1) the adduct of 7 mol of ethylene oxide onto 1 mole of tallow fatty amine quaternized with chloroacetamide and (2) the ammonium salt of the acidic sulphuric monoester of the adduct of 7 mol of ethylene oxide onto 1 mole of tallow fatty amine (mixing ratio 1:1), the liquor being constantly agitated.

0.4 g of a dye of the formula

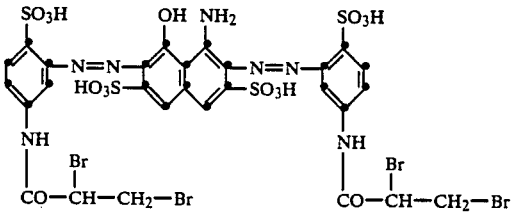

(22)

is then added. The pH of the dyeing bath is 4.5–5. The bath temperature is increased to the boiling temperature at a rate of 0.5°–1° C. per minute and maintained at 98°–100° C. for 60–90 minutes. The dyeing bath is then cooled to 85° C. and adjusted to a pH of 8.5 with aqueous ammonia (25%). The material to be dyed is then maintained at 85° C. and a pH of 8.5 for 10–15 minutes. The material to be dyed is then rinsed as usual with 300 ml of water containing 0.3 g of 85% formic acid, acidified and dried. A blue-black worsted yarn having good wearing properties is obtained. During the entire dyeing process, no precipitations have occurred. The dyeing glass and the material carrier show no staining whatsoever.

The procedure of example 2 is repeated, using an equivalent amount of a dye of the formula

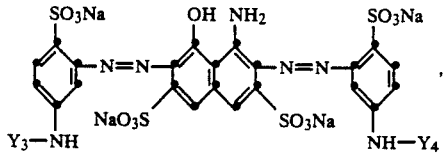

(8)

in which $Y_3$ and $Y_4$ are as defined in columns 2 and 3 of the table below instead of the dye of the formula (22) to give likewise blue-black dyeings having equally good fastness properties.

| Example | $Y_3$ | $Y_4$ |
|---|---|---|
| 3 | —CO—CBr=$CH_2$ | —CO—CBr=$CH_2$ |
| 4 | —CO—CBr=$CH_2$ | —CO—CHBr—$CH_2$Br |
| 5 | —CO—CHBr—$CH_2$Br | —CO—CBr=$CH_2$ |
| 6 | —CO—CHBr—$CH_2$Br | 2,4-difluoro-5-chloro-pyrimidin-6-yl |
| 7 | 2,4-difluoro-5-chloro-pyrimidin-6-yl | —CO—CHBr=$CH_2$Br |
| 8 | 2,4-difluoro-5-chloro-pyrimidin-6-yl | —CO—CBr=$CH_2$ |
| 9 | 2,4-difluoro-5-chloro-pyrimidin-6-yl | 2,4-difluoro-5-chloro-pyrimidin-6-yl |
| 10 | —CO—CBr=$CH_2$ | 2,4-difluoro-5-chloro-pyrimidin-6-yl |
| 11 | —CO—CHBr—$CH_2$—Br | 2,4-difluoro-5-chloropyrimidin-6-yl |
| 12 | 2,4,5-trichloropyrimidin-6-yl | 2,4,5-trichloropyrimidin-6-yl |
| 13 | —CO—CHBr—$CH_2$Br | 2,4,5-trichloropyrimidin-6-yl |
| 14 | 2,4,5-trichloropyrimidin-6-yl | —CO—CBr=$CH_2$ |

EXAMPLE 15

100 kg of wool fabric are pretreated at 40° C. for 10 minutes in a dye bath containing, per 1000 kg of water at 40° C., 2 kg of 80% acetic acid, 1.5 kg of assistant mixture $A_1$ consisting of (1) the adduct of 7 mol of ethylene oxide onto 1 mole of tallow fatty amine quaternized with chloroacetamide and (2) the ammonium salt of the acidic sulphuric monoester of the adduct of 7 mol of ethylene oxide onto 1 mole of tallow fatty amine (mixing ratio 1:1) and 1 kg of an adduct of 18 mol of ethylene oxide onto 1 mole of a $C_{12}$–$C_{18}$ fatty alcohol mixture. The pH is 4.5.

After adding a solution containing 5 kg of a disazo dye of the formula (22), the dyeing liquor is maintained at 40° C. for another 10 minutes and then heated to 70° C. at a heating rate of 1° C./min. After the mixture is maintained at 70° C. for 15 minutes, it is heated to 98° C. After a dyeing time of 90 minutes at 98° C., it is cooled to 85° C., adjusted to a pH of 8.5 with ammonia and treated at 85° C. for 15 minutes. After cooling to 60° C., the liquor is discharged.

The blue-black fabric is rinsed as usual, acidifed with 1 kg of 85% formic acid and dried. The dyeing is level and has good fastness properties. The dyeing apparatus and the material carrier (perforated beam) are completely clean.

EXAMPLE 16

100 kg of wool yarn in the form of packages are pretreated at 40° C. for 10 minutes in a dye bath containing, per 1000 kg of water at 40° C., 2 kg of 80% acetic acid, 1.5 kg of assistant mixture $A_1$ consisting of (1) the adduct of 7 mol of ethylene oxide onto 1 mole of tallow fatty amine quaternized with chloroacetamide and (2) the ammonium salt of the acidic sulphuric monoester of the adduct of 7 mol of ethylene oxide onto 1 mole of tallow fatty amine (mixing ratio 1:1) and 1 kg of an adduct of 18 mol of ethylene oxide onto 1 mole of a $C_{12}$–$C_{18}$ fatty alcohol mixture. The pH is 4.5.

After adding a solution containing 5 kg of a dye of the formula

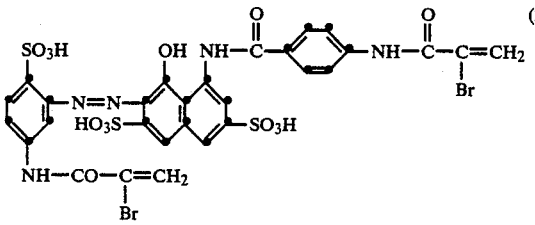

and 2 kg of a dye of the formula

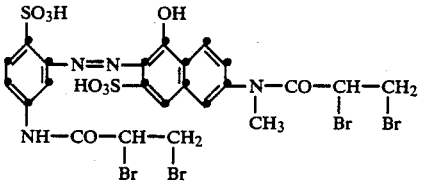

the dying liquor is maintained at 40° C. for another 10 minutes and then heated to 70° C. at a heating rate of 1° C./min. The liquor is maintained at 70° C. for 15 minutes and then heated to 98° C. After a dyeing time of 90 minutes at 98° C., it is cooled to 85° C., adjusted to a pH of 8.5 with ammonia and treated at 85° C. for 15 minutes. After cooling to 60° C., the liquor is discharged.

The brilliant red yarn is rinsed as usual, acidified with 1 kg of 85% formic acid and dried. The dyeing is level and has good fastness properties. The dyeing apparatus and the material carrier are completely clean.

EXAMPLE 17

100 kg of wool fabric are pretreated at 40° C. for 10 minutes in a dye bath containing, per 1000 kg of water at 40° C., 8 kg of sodium sulphate, 2 kg of 80% acetic acid, 1.5 kg of assistant mixture $A_1$ consisting of (1) the adduct of 7 mol of ethylene oxide onto 1 mole of tallow fatty amine quaternized with chloroacetamide and (2) the ammonium salt of the acidic sulphuric monoester of the adduct of 7 mol of ethylene oxide onto 1 mole of tallow fatty amine (mixing ratio 1:1) and 1 kg of an adduct of 18 mol of ethylene oxide onto 1 mole of a $C_{12}$–$C_{18}$ fatty alcohol mixture. The pH is 4.5.

After adding a solution containing 2 kg of a dye of the formula

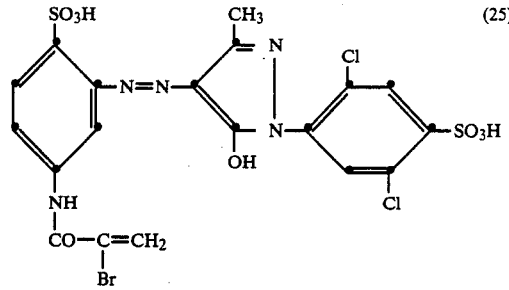

3 kg of a dye of the formula

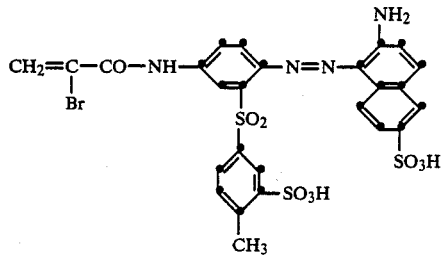

and 2 kg of a dye of the formula

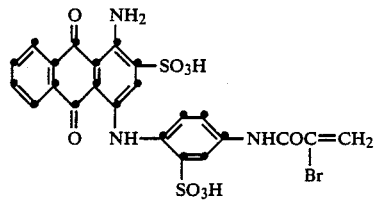

the dyeing liquor is maintained at 40° C. for another 10 minutes and then heated to 70° C. at a heating rate of 1° C./min. It is maintained at 70° C. for 15 minutes and then heated to 98° C. After a dyeing time of 90 minutes at 98° C., it is cooled to 85° C., adjusted to a pH of 8.5 with ammonia and treated at 85° C. for 15 minutes. After a cooling to 60° C., the liquor is discharged.

The dark brown yarn is rinsed as usual, acidified with 1 kg of 85% formic acid and dried. The dyeing is level and has good fastness properties. The dyeing apparatus and the material carrier are completely clean.

EXAMPLE 18

100 kg of wool fabric are pretreated at 50° C. for 15 minutes in a dye bath containing, per 1000 kg of water at 50° C., 1,2 kg of 85% formic acid, 1,2 kg of the assistant mixture $A_2$ consisting of (1) the adduct of 34 mol of ethylene oxide onto 1 mole of $C_{20}$–$C_{22}$ fatty amine quaternized with dimethyl sulphate and (2) the ammonium salt of the acidic disulphuric ester of the adduct of 8 mol of ethylene oxide onto 1 mole of tallow fatty amine (mixing ratio 1:1) and 1 kg of an adduct of 18 mol of ethylene oxide onto 1 mole of a $C_{12}$–$C_{18}$ fatty alcohol mixture. The pH is 4.3.

After adding a solution containing 8 kg of a disazo dye of the formula (22), the dyeing liquor is maintained at 50° C. for another 10 minutes and then heated to 70°

C. at a heating rate of 1° C./min. After the mixture is maintained at 70° C. for 15 minutes, it is heated to 98° C. After a dyeing time of 90 minutes at 98° C., it is cooled to 85° C., adjusted to a pH of 8.5 with ammonia and treated at 85° C. for 15 minutes. After cooling to 60° C., the liquor is discharged.

The blue-black fabric is rinsed as usual, acidified with 1 kg of 85% formic acid and dried. The dyeing is level and has good fastness properties. The dyeing apparatus and the material carrier (perforated beam) are completely clean.

EXAMPLE 19

100 kg of wool fabric are pretrated at 50° C. for 15 minutes in a dye bath containing, per 1000 kg of water at 50° C., 1,2 kg of 85% formic acid, 1,5 kg of the assistant mixture $A_3$ consisting of (1) the adduct of 7 mol of ethylene oxide onto 1 mole of tallow fatty amine quaternized with chloroacetamide and (2) the sodium salt of the maleic acid half ester of the adduct of 34 mol of ethylene oxide and 6 mol of propylene oxide onto 1 mole of behenylamine (mixing ratio 1:1) and 1 kg of an adduct of 18 mol of ethylene oxide onto 1 mole of a $C_{12}$–$C_{18}$ fatty alcohol mixture. The pH is 4.3.

After adding a solution containing 8 kg of a disazo dye of the formula (22), the dyeing liquor is maintained at 50° C. for another 10 minutes and then heated to 70° C. at a heating rate of 1° C./min. After the mixture is maintained at 70° C. for 15 minutes, it is heated to 98° C. After a dyeing time of 90 minutes at 98° C., it is cooled to 85° C., adjusted to a pH of 8.5 with ammonia and treated at 85° C. for 15 minutes. After cooling to 60° C., the liquor is discharged.

The blue-black fabric is rinsed as usual, acidified with 1 kg of 85% formic acid and dried. The dyeing is level and has good fastness properties. The dyeing apparatus and the material carrier (perforated beam) are completely clean.

What is claimed is:

1. A process for the dyeing of natural polyamide fibres by means of the exhaust method, which comprises the step of contacting the fibers with an aqueous dye liquor which contains a reactive dye and a dyeing assistant consisting essentially of (a) a quaternary ammonium compound of the formula

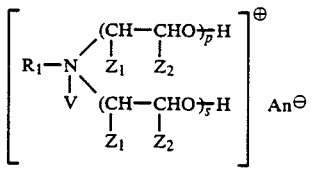

wherein $R_1$ is an aliphatic hydrocarbon radical having 12 to 22 carbon atoms, V is a substituted or unsubstituted alkyl radical, one of $Z_1$ and $Z_2$ is hydrogen, methyl or phenyl and the other is hydrogen, $An^{\ominus}$ is an anion of an inorganic or organic acid and p and s are each 1 to 100, the sum of p and s being 2 to 100 and (b) an acidic ester or a salt of an acidic ester of a polyglycol compound of the formula

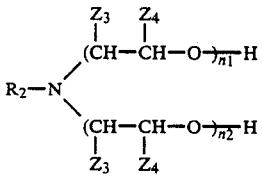

wherein $R_2$ is an aliphatic hydrocarbon radical having 12 to 22 carbon atoms, one of $Z_3$ and $Z_4$ is hydrogen, methyl or phenyl and the other is hydrogen and $n_1$ and $n_2$ are whole numbers, the sum $n_1+n_2$ being 2 to 100, or a quaternized product of the acid ester or a salt thereof, and (c) a fatty alcohol/polyalkylene glycol ether of the formula $$R—O—(alkylene—O)_m—$$

wherein R is an aliphatic radical having at least 8 carbon atoms, "alkylene" is an ethylene radical or a propylene radical and m is 3 to 25 and wherein the weight ratio of the mixture of the components (a) and (b) to the component (c) is 2:1 to 1:1.

2. A process according to claim 1, wherein R is an alkyl or alkenyl radical having 12 to 22 carbon atoms.

3. A process according to claim 1, wherein "alkylene" is ethylene.

4. A process according to claim 1, wherein m is 10 to 20.

5. A process according to claim 1, wherein m is 12 to 18.

6. A process according to claim 1, wherein components (a) and (b) are present in a weight ratio of 1:3 to 3:1 to one another.

7. A process according to claim 1, wherein the dyeing assistant mixture consists of (Aa) a quaternary ammonium salt of the formula

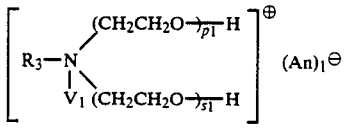

(5)

and (Bb) an acidic ester or a salt thereof of a compound of the formula

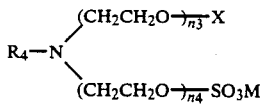

(6)

as components (a) and (b), wherein

X is hydrogen or $SO_3M$, M is hydrogen, an alkali metal or $—NH_4$, $R_3$ and $R_4$, independently of one another, are each alkyl or alkenyl having 12 to 22 carbon atoms, $V_1$ is methyl, ethyl, benzyl, $—CH_2CO—NH_2$ or $$—CH_2—\underset{\underset{OH}{|}}{CH}—CH_2Cl,$$

$(An)_1^{\ominus}$ is the chloride or methylsulphate ion, $s_1$, $p_1$, $n_3$ and $n_4$ are whole numbers, the sums of $(p_1+s_1)$ and $(n_3+n_4)$ being 5 to 15 in each case.

8. The process of claim 1, wherein the weight ratio of the mixture of components (a) and (b) to the component (c) is 1.6:1 to 1.2:1.

9. A process according to claim 1, wherein the reactive dye contains at least two sulpho groups.

10. A process according to claim 9, wherein the reactive dye has the formula

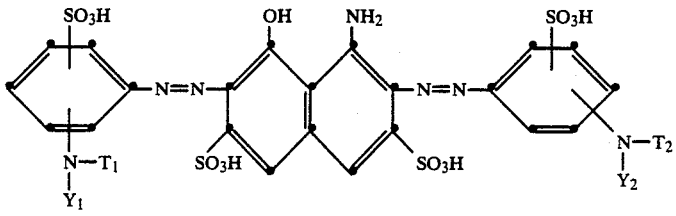

(7)

wherein $T_1$ and $T_2$, independently of one another, are each hydrogen or $C_1$–$C_4$alkyl and $Y_1$ and $Y_2$, independently of one another, are each chloroacetyl, α-bromoacryloyl, α,β-dibromopropionyl, 2,4-dichloro-s-triazinyl, 2,4-difluoro-5-chloropyrimidin-6-yl or 2,4,5-trichloropyrimidin-6-yl.

11. The process of claim 10, wherein $Y_1$ and $Y_2$ in ormula (7) are each α-bromoacryloyl or α,β-dibromopropionyl.

12. A process according to claim 10, wherein the reactive dye has the formula

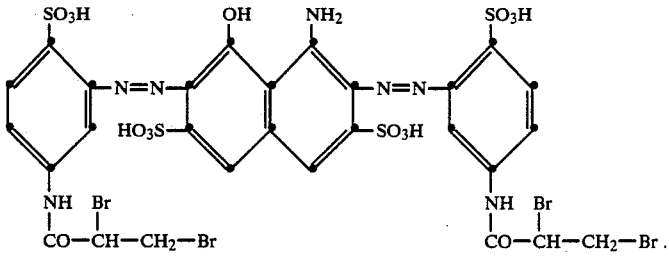

13. A process according to claim 1, wherein the polyamide fibres are wool.

* * * * *